US007661267B2

(12) United States Patent
Pollarolo

(10) Patent No.: US 7,661,267 B2
(45) Date of Patent: Feb. 16, 2010

(54) SYSTEM FOR DAMPING THERMO-ACOUSTIC INSTABILITY IN A COMBUSTOR DEVICE FOR A GAS TURBINE

(75) Inventor: Giacomo Pollarolo, Genoa (IT)

(73) Assignee: Ansaldo Energia S.p.A., Genoa (IT)

( * ) Notice: Subject to any disclaimer, the term of this patent is extended or adjusted under 35 U.S.C. 154(b) by 214 days.

(21) Appl. No.: 10/596,497

(22) PCT Filed: Dec. 15, 2004

(86) PCT No.: PCT/EP2004/053524

§ 371 (c)(1),
(2), (4) Date: Jul. 6, 2007

(87) PCT Pub. No.: WO2005/059441

PCT Pub. Date: Jun. 30, 2005

(65) Prior Publication Data

US 2008/0216481 A1 Sep. 11, 2008

(30) Foreign Application Priority Data

Dec. 16, 2003 (IT) ..... TO2003A1013

(51) Int. Cl.
*F02C 7/24* (2006.01)

(52) U.S. Cl. ..... 60/725

(58) Field of Classification Search ..... 60/725; 181/213; 431/114; 123/184.57
See application file for complete search history.

(56) References Cited

U.S. PATENT DOCUMENTS

| | | | | |
|---|---|---|---|---|
| 2,807,931 | A | 10/1957 | Bodine, Jr. | |
| 5,373,695 | A | 12/1994 | Aigner et al. | |
| 6,370,879 | B1 * | 4/2002 | Stalder et al. | 60/725 |
| 6,464,489 | B1 * | 10/2002 | Gutmark et al. | 431/1 |
| 6,530,221 | B1 | 3/2003 | Sattinger et al. | |
| 2002/0108810 | A1 | 8/2002 | Kudernatsch | |
| 2004/0211185 | A1 | 10/2004 | Young et al. | |
| 2004/0248053 | A1 | 12/2004 | Benz et al. | |

FOREIGN PATENT DOCUMENTS

| | | |
|---|---|---|
| EP | 0597138 | 5/1994 |
| EP | 1434006 | 6/2004 |
| GB | 2288660 | 10/1995 |
| JP | 51-014550 | 2/1976 |
| WO | 03/023281 | 3/2003 |

* cited by examiner

*Primary Examiner*—Michael Cuff
*Assistant Examiner*—Andrew Nguyen
(74) *Attorney, Agent, or Firm*—Greenblum & Bernstein P.L.C.

(57) ABSTRACT

A system for damping thermo-acoustic instability in a combustor device for a gas turbine, the combustor device including at least one combustion chamber, in particular of an annular type, and at least one burner associated to the combustion chamber and mounted in a position corresponding to a front portion set upstream of the combustion chamber; the damping system including at least one Helmholtz resonator including a casing defining inside it a pre-set volume and a neck for hydraulic connection between the pre-set volume and the combustion chamber, the neck being connected to one side of the combustion chamber at a distance from the front upstream portion thereof provided with the at least one burner. The casing of the resonator includes structure which varies the pre-set volume within a pre-set range and structure which delivers a cooling fluid.

9 Claims, 2 Drawing Sheets

SYSTEM FOR DAMPING THERMO-ACOUSTIC INSTABILITY IN A COMBUSTOR DEVICE FOR A GAS TURBINE

TECHNICAL FIELD

The present invention relates to a system for damping thermo-acoustic instability in a combustor device comprising at least one combustion chamber and at least one burner associated to said combustion chamber and designed to serve a gas turbine, which uses passive damping means, in particular Helmholtz resonators.

BACKGROUND ART

It is known that, to achieve increasingly higher efficiency in gas turbines, in particular latest-generation ones, it is necessary both to use increasingly higher start-of-expansion temperatures and to obtain, in the most efficient way possible, an optimal homogeneity of temperature on the blades. Said results can be achieved and, in actual fact, are currently achieved, using combustion chambers with annular geometry.

The aforementioned combustion chambers enable excellent performance both as regards efficiency of combustion and as regards the limitation of pollutant emissions and the high density of thermal yield ($MWth/m^3$). However, on the basis of the results of some verifications, it may be stated that the annular geometry associated to high densities of thermal yield can favour onset of phenomena of thermo-acoustic instability. The latter occur with marked oscillations of pressure within the combustion chamber, at well-defined frequencies that are characteristic of the geometry of the combustor and of the running conditions. Said oscillations can bring about undesirable vibrations in the turbine and damage its components.

To limit this problem, manufacturers of gas turbines have developed various techniques.

Some techniques are based upon decoupling of the forcing frequencies, generated by the peculiarities of the burner, from the natural frequencies of the mechanical system that enters into vibration. Other techniques are based upon control of the fuel in phase opposition with the onset of the pressure oscillations (active control). However, these methods, which are prevalently of an active type, have moving members and/or need to undergo operations of control and adjustment during the operating cycle of the gas turbine.

Also known are passive-damping systems, based upon the use of dissipater devices, in particular Helmholtz resonators, which capture the acoustic waves and dampen their amplitude, dissipating the energy thereof.

For example, the U.S. Pat. No. 6,530,221 relates to a system in which the dissipaters used are not Helmholtz resonators, but perforated box-section elements. A dissipater element of this type can give rise to the following problems:

1) the blades of the turbine may suffer damage in the case where one of the box-section elements is damaged on account of vibrations; and
2) application of the box-section elements is possible only on combustors of a cannular type and not on annular ones, in so far as, in the solution provided by the patent, the resonator is mounted on the can.

The U.S. Pat. No. 6,530,221 describes the use of a resonator device for application of which it is necessary to redesign the air chamber (i.e., a casing which surrounds the combustion chamber and delivers thereto the air for supporting combustion) and the combustion chamber. The mechanism for regulating the volume of the resonator proves moreover very delicate.

The British patent application GB 2 288 660 A describes a system in which the resonators used are classic Helmholtz resonators, sized according to relations available in the literature. However, the position in which the resonators should be mounted on the combustion chamber to be effective is not clarified. Furthermore, the volume of the resonator is not adjustable, so that the operating frequency is fixed. In order to overcome this drawback, the resonators are provided with a complicated system for regulation of the internal temperature so as to be able to regulate the frequency according to the temperature. In theory, the system is flexible, but at the expense of complications in terms of plant design and instrumentation, which limits the reliability thereof in an environment that is particularly critical, as regards temperature and pressure, as is that of a gas turbine.

Finally, the European patent application No. 0 597 138 A1 describes the application of a Helmholtz resonator to an annular combustion chamber, said resonator being mounted on the side of the combustion chamber ("upstream" portion or "front plate") that carries the burner or burners. Hereinafter, the terms "upstream" and "downstream" are intended as referring to the direction of flow of the burnt gases in the combustion chamber.

Also in this case, the volume of the resonator is not adjustable, so that the operating frequency is fixed. Consequently, if the range of frequencies in which the resonator is effective is very restricted, as proves likely from the drawings (a range which, however, in this document is not defined, even indirectly), the damping could be insufficient in various operating conditions. Furthermore, the position of installation chosen for the resonator, as has been experimentally found by the technicians of the present applicant, is not the optimal position for its operation. In addition, for reasons of encumbrance, application of the resonator in the way indicated in EP 0597138A1 is not possible on combustion chambers different from the one hypothesized: for example, in the case of the majority of known turbines it would be necessary to redesign the air chamber and the combustion chamber.

Finally, it is to be highlighted that all the known solutions described above do not define the range of frequencies in which the resonator is effective, nor the effectiveness of damping of the pressure waves. Consequently, the state of the art that illustrates the application of passive resonators/dampers to combustion chambers of gas turbines in practice merely provides nothing but speculations as regards the possible effectiveness of the solutions proposed, without in effect providing to the person skilled in the branch any indication supported by experimental findings.

DISCLOSURE OF INVENTION

A purpose of the present invention is to provide a system for damping thermo-acoustic instability in a combustor device for a gas turbine which will be free from the drawbacks described and will be of proven effectiveness.

Another purpose of the invention is to provide a system for damping thermo-acoustic instability in a combustor device for a gas turbine that will be of contained overall dimensions and, in general, such as to enable application thereof to any annular combustion chamber of a known type, that will enable ease of installation and maintenance, contained costs, high reliability and a structure such as to enable a simple and fast regulation of the volume of the resonator or resonators.

According to the invention there is hence provided a system for damping thermo-acoustic instability in a combustor device for a gas turbine according to what is defined in claim 1.

In practice, the system for damping thermo-acoustic instability according to the invention can be used on combustors that include a combustion chamber of an annular type and a plurality of burners associated to the combustion chamber and mounted in a position corresponding to a front upstream portion of the combustion chamber, where the term "upstream", as likewise the term "downstream", used here and in what follows, are to be understood as referring to the direction of flow of burnt gases traversing the combustion chamber, for example directed towards the first stage of a gas turbine served by the aforesaid combustor device.

The damping system according to the invention comprises a plurality of Helmholtz resonators, each of which comprises a casing defining within it a pre-set volume and a neck for hydraulic connection between said pre-set volume and said combustion chamber. According to the invention, said damping system is characterized in that the necks are all connected to one side of the combustion chamber distant from the front upstream portion thereof provided with the burners, in particular to a downstream portion of the combustion chamber.

Each resonator is placed asymmetrically in a circumferential position around the combustion chamber, housed within a supporting combustion air delivery casing set outside an annular body delimiting the combustion chamber itself. Preferably, the casing of each resonator comprises means for delivery of a cooling fluid consisting of a plurality of asymmetrical through holes made in an end plate of the casing, which is set facing the side opposite to the combustion chamber and through which a part of air for supporting combustion is conveyed towards the combustion chamber through the pre-set volume and the neck of each resonator.

Preferably, the casing of each resonator comprises means for regulation of said pre-set volume, according to which the casing comprises two cup-shaped tubular bodies, which are mounted in a telescopic way co-axially on one another, with respective concavities facing one another, by means of a threaded coupling. A threaded ring-nut is designed to act as locknut fox selective blocking of the two tubular bodies in a plurality of different relative axial positions, in which one is more or less screwed on the other.

In this way, the invention surprisingly achieves the purposes outlined above. In fact, the geometry described maximizes the range of frequencies which can be dampened, rendering unnecessary the adoption of any "active" feedback control system, which could reduce the reliability of the system. Furthermore, said range of frequencies that can be dampened can be easily regulated as a function of the fuel used and other operating parameters which can vary case by case, in the step of starting of the gas turbine, simply by varying just once the pre-set volume defined internally by each resonator casing.

The system according to the invention hence presents the following advantages:

- it overcomes the limits of the known art, referred to previously, because it does not have any moving members nor does it need any control/regulation;
- the resonators are of a very simple and economically advantageous mechanical construction and do not call for any particular technology;
- installation of the resonators is particularly simple; and
- introduction of the resonators into an existing combustor device does not interfere in the least with the combustion stoichiometry, the fluid-dynamics, or the global performance of the combustor and, consequently, does not require any verification or modification thereof.

BRIEF DESCRIPTION OF THE DRAWINGS

Further purposes and advantages of the present invention will emerge clearly from the ensuing description of a non-limiting embodiment thereof, which is provided merely as an example, with reference to the figures of the annexed drawings, in which.

BEST MODE FOR CARRYING OUT THE INVENTION

Figure 1:
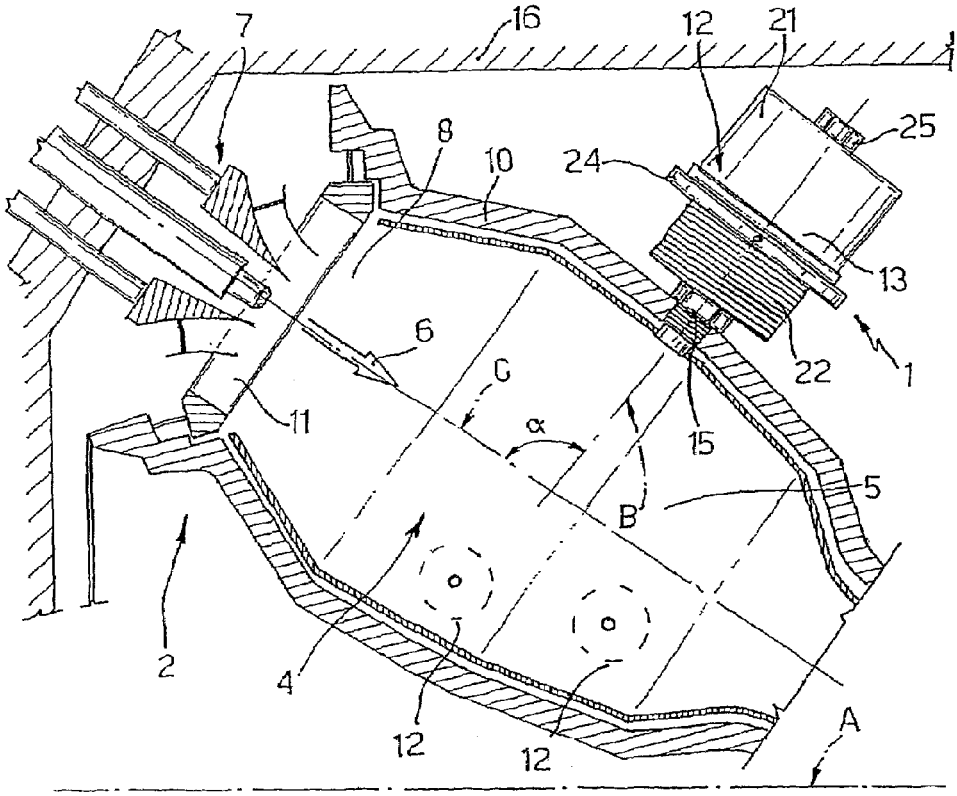
FIG. 1 is a schematic longitudinal sectional view of a combustor device for a gas turbine (known and not illustrated) provided with the system for damping thermo-acoustic instability according to the invention.
Figure 3:
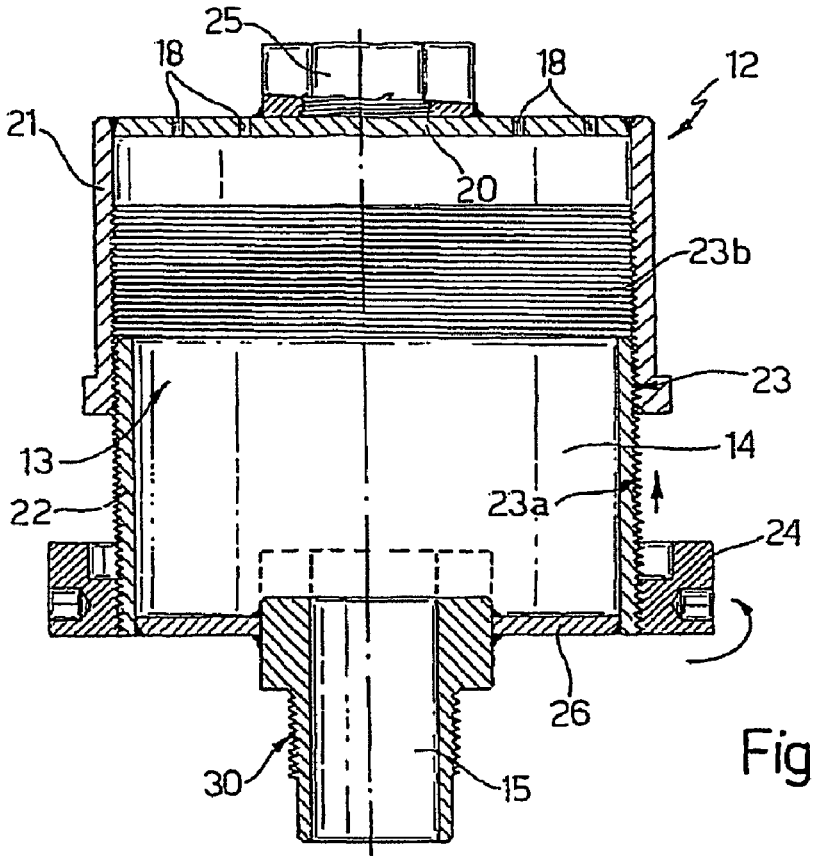
FIG. 3 is a view sectioned according to the plane III-III of the resonator of FIG. 2.
Figure 2:
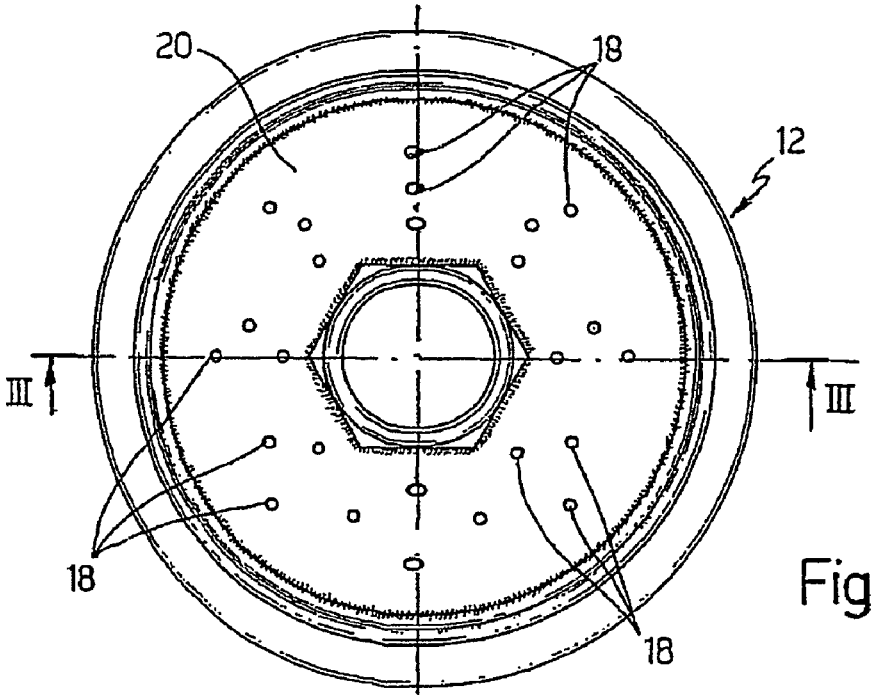
FIG. 2 is a top plan view, at an enlarged scale, of a resonator forming part of the system for damping thermo-acoustic instability according to the invention.

With reference to FIGS. 1, 2 and 3, designated as a whole by 1 is a system for damping thermo-acoustic instability in a combustor 2 for a gas turbine of any known type and consequently not illustrated for reasons of simplicity. The combustor device comprises a combustion chamber 4 of an annular type, having an axis of symmetry A which coincides with the axis of rotation of the aforesaid gas turbine (not illustrated). A portion 5 set downstream with respect to a flow 6 of burnt gases (indicated by the arrow) of the combustion chamber 4 is connected (in a way that is known and is not illustrated) with at least one expansion stage of the aforesaid turbine. At least one burner 7 (illustrated only schematically) of any known type, is associated to the combustion chamber 4, in the case in point mounted in a position corresponding to a front upstream portion 8 of the combustion chamber 4.

In the case in point, the combustion chamber 4, which is delimited by an annular body 10, is served by a plurality of burners 7 (only one of which is illustrated for reasons of simplicity), carried symmetrically in a ring by an annular element 11 of the body 10 in a position corresponding to the upstream portion 8 thereof.

The damping system 1 comprises at least one Helmholtz resonator 12, which in turn comprises a casing 13 defining inside it (FIG. 3) an empty volume 14 having a pre-set size, and a neck 15 for hydraulic connection between the volume 14 and the combustion chamber 4. According to the invention, the neck 15 is connected to one side of the combustion chamber 4 at a distance from the front upstream portion 8 thereof provided with the burner or burners 7.

In particular, the damping system according to the invention comprises a plurality of Helmholtz resonators 12 (only one of which is illustrated for reasons of simplicity and which, in what follows, will be indicated more briefly only as "resonators 12"), which are identical to one another and are mounted circumferentially in a ring in cantilever fashion on the annular body 10, with the respective necks 15 hydraulically connected to the downstream portion 5 of the combustion chamber 4. According to an aspect of the invention, the resonators 12 are mounted in positions that are asymmetrical with respect to one another, both in the radial direction and in the axial direction, with reference to the axis of symmetry A. In other words, they are arranged circumferentially set at a distance apart from one another and axially at a distance from the burners 7, i.e., from the annular element 11 carrying said burners, with an irregularly varying pitch.

The resonators 12 are housed within a case 16, known as "air chamber" or "air case" and illustrated only partially and schematically in FIG. 1, for delivery of air for supporting combustion. The air case 16 is set outside the annular body 10 and is shaped so as to be designed to feed air for supporting combustion directly to each burner 7, through the annular element 11.

The casing 13 and the neck 15, of each resonator 12, have a cylindrical symmetry and are arranged with respective axes of symmetry thereof (in the case in point illustrated as coinciding with one another and designated by B in FIG. 1) a1igned with one another and oriented to form in the longitudinal section of FIG. 1, a pre-set angle $\alpha$, preferably substantially of 900, with the direction of flow 6 of burnt gases that, in use, traverse the combustion chamber 4. This coincides with the direction of orientation of the axis of symmetry of each burner 7, designated by C in FIG. 1.

According to a preferred aspect of the invention, the casing 13 of the resonators 12 comprises means for delivery of a cooling fluid, in the case in point consisting of a plurality of holes 18 of pre-set diameter made through the casing 13 and designed to enable passage of (a small) part of the air for supporting combustion directly from the delivery air case 16 towards the combustion chamber 4 through the pre-set volume 14 and the neck 15 of each of the resonators 12.

The holes 18 are made only through an end plate 20 of the casing 13, facing in use the side opposite to the combustion chamber 4, and are arranged in positions that are mutually asymmetrical, as may be clearly seen in FIG. 2.

According to a further preferred aspect of the invention, the casing 13 of each of the resonators 12 comprises means for selectively varying the pre-set volume 14 within a pre-set range.

Said means for selectively varying the pre-set volume 14 of each resonator 12 consist of a particular structure of the casing 13 of the resonators 12, which comprises two cup-shaped tubular bodies 21, 22, which are mounted in a telescopic way co-axially on one another (FIG. 3), with respective concavities facing one another, by means of a threaded coupling 23. A threaded ring-nut 24 is coupled outside on the tubular body 22 of smaller diameter, which, in the non-limiting case illustrated here, is the one set facing, in use, the body 10 and which is consequently provided, in a single piece, with the neck 15 and is provided on the outside with a male part 23*a* of the threaded coupling 23. The threaded ring-nut 24 is designed, in use, to bear axially upon the tubular body 21 of larger diameter, which can be screwed outside on the tubular body 22, thanks to a female part 23*b* of the threaded coupling 23, on the side opposite to the combustion chamber 4.

The structure described of the casing 13 of each resonator 12 enables in use, in particular during the step of starting of the gas turbine and of the corresponding plant, calibration of the natural frequency of the resonator, which can thus be tuned to the natural frequencies of the combustor 2 that are to be dampened. In fact, said natural frequency is determined by the size of the volume 14, as well as by the number, diameter and length of the necks, number and size of the holes 18, and by the mean temperature of the gas present in the volumes 14 and in the necks 15, which is a function also of the type of fuel used for supplying the gas turbine. For more consolidated applications, it is of course possible to build resonators 12 with a fixed volume 14, in which the two tubular elements 21, 22 are not relatively mobile.

In use, the air contained in the volumes 14 determines the stiffness of the damping system. The holes 18 can have diameters of between 1.5 mm and 4.5 mm and must be present in a number such as to enable a good cooling of the resonators 12, without altering the fluid-dynamics of cooling of the refractory element present in the combustion chamber 4.

To enable ease of manoeuvring of the tubular elements 21, 22, the outermost tubular element 21, fixed to the plate 20, is provided, in a single piece, on its top end portion, with a nut 25, which has the function of tightening the tubular element 21 against the ring-nut 24, at the pre-set distance. The ring-nut 24 is screwed onto the male part 23*a* of the threaded coupling 23 so as to force connection thereof and to serve as a locknut.

The necks 15 are mounted in use so as to present their own outlet ends inside the internal volume of the combustion chamber 4, in the case in point of the downstream portion 5 thereof. They can extend (FIG. 3, part illustrated hatched), in some cases, within the pre-set volume 14 delimited by the coupled tubular elements 21, 22 and, hence, beyond a plate 26 (FIG. 3) of the tubular element 22 which carries, integral in one piece, the respective neck 15. Said configuration is adopted in order to increase the resonant mass, given the same overall dimensions along the axis B of the resonator. The end of the neck 15 that impinges upon the plate 26 at the base of the pipe is provided with means for coupling to the body 10, for example projections or else a threaded coupling 30.

The resonators, by their very nature, function most efficiently when they are set in the proximity of the areas with maximum acoustic pressure. However, the angular position of said areas is not exactly foreseeable in a simple way, in so far as the combustion chamber has an axial symmetry.

Said angular position is moreover caused by the small constructional differences of the burners.

On the other hand, the axial position of the peaks of acoustic pressure is located in an area corresponding to the area of transition, where the combustion reaction is completed, but can be determined only empirically, using a certain number of dynamic-pressure gauges, or else constructed theoretically using finite-element or boundary-element programs.

Experimental tests conducted by the present applicant have made it possible to show that, to be effective, the resonators must be positioned in an adequate number along the circumference of the combustion chamber and, preferably, their mutual arrangement must not present axial symmetry. They must moreover be arranged in a position corresponding to the downstream portion of the combustion chamber or in any case in a position corresponding to the side thereof at a greater distance from the burners.

Finally, the present invention is further described by the example appearing below.

EXAMPLE OF APPLICATION

The damping system presented in the foregoing description, with reference to the annexed plate of drawings was tested in an experimental annular combustor manufactured by the present applicant, where a number of resonators were installed in conformance with the drawing of FIG. 3, said resonators being distributed along the circumference of the combustion chamber in the positions indicated in FIG. 1. More in particular, the annular combustor was connected to an existing (40-MWth) boiler and was made up of the following components;

- a combustion chamber of a commercially available AEN/SIE GT;
- twenty-four AEN/SIE hybrid burners;
- a natural-gas (NG) supply system for operating in diffusion, premixing, and pilot modes;
- an air supply from the fan of the boiler provided with a pre-heater for pre-heating up to 350° C.; and
- a chimney (the same as that of the boiler).

The instrumentation used comprised:

a meter for measuring the flow, pressure, and temperature of each flow;

a meter for measuring the difference in pressure (ΔP) through the combustion chamber;

two dynamic pressure transducers installed on the air chamber;

ten dynamic-pressure transducers installed in appropriately selected positions of the combustion chamber;

two dynamic-pressure transducers installed on the Belmholtz resonators;

twenty-four thermocouples installed in a position corresponding to the outlet of the exhaust gas; and samples of exhaust gas for carrying out chemical analysis.

A data-acquisition system was installed, capable of storing the static and dynamic synchronized data and of performing calculation of Fourier transform (FFT) of the signals for dynamic pressure.

A first series of tests was completed using the standard configuration of the combustor in order to determine the thermo-acoustic limits corresponding to different boundary conditions. Then, a set of Helmholtz resonators was installed, the resonators being spaced in an axial and circumferential direction, and the thermo-acoustic limits were studied again, using the same boundary conditions and varying the internal volume of the resonator in order to regulate the dampened frequencies.

A large data bank is available, containing the results of the tests.

The aforementioned tests consisted in reproducing the combustion conditions that occur under normal operation of the gas turbine and as the parameters influencing, above all, onset of thermo-acoustic instability were then varied. These parameters were, basically, the flow of air for supporting combustion and the flow of fuel.

Figure 4:
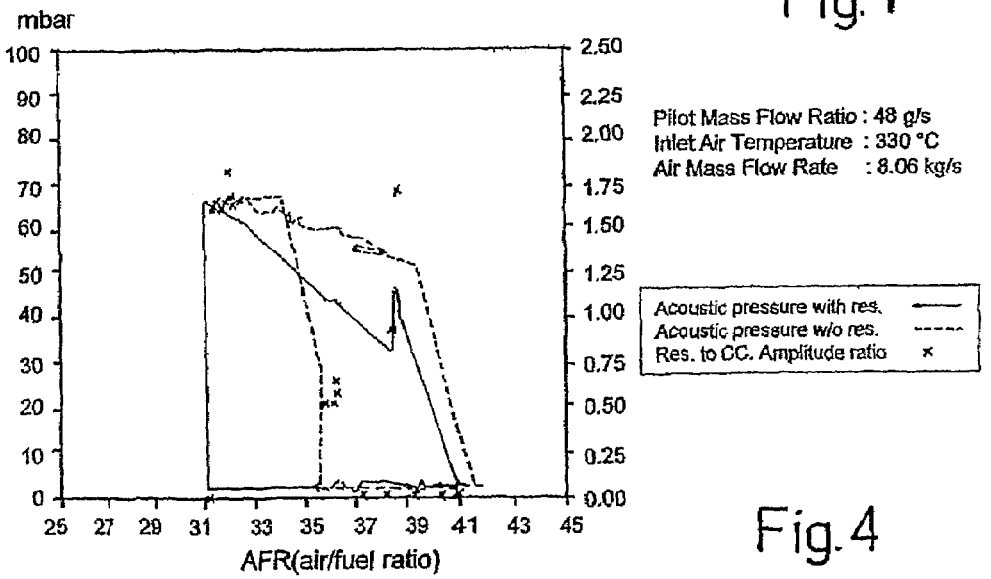
FIG. 4 is a graph that summarizes comparative experimental results of studies carried out on one and the same turbine and one and the same combustor, respectively with and without the system for damping thermo-acoustic instability of the invention.

On the basis of said tests, graphs were obtained, which give, on the abscissa, the excess air (air flow/fuel flow ratio) and, on the ordinate, the pressure oscillation that is measured in the combustion chamber (expressed in mbar), via particular piezoelectric sensors. For each running condition tested (fuel flow of the pilot flame, temperature of the air for supporting combustion, flow of air for supporting combustion), a curve of the type given in FIG. 4 was obtained.

The above tests were carried out starting from conditions of high stability, which occur for high air/fuel ratios (AFRs). Next, the AFR was decreased until the first oscillations in the combustion chamber occurred (sharp rise in the mbar measured). Once the condition of instability was reached, the AFR was increased until stable conditions were restored. It was noted that the phenomenon presents a hysteresis; i.e., the instability does not disappear at the same AFR value at which it appeared, but it is necessary to go to significantly higher values. This behaviour emerges clearly from FIG. 4, where the cycles of hysteresis measured both in the presence of resonators and in the absence thereof are compared.

The results of the tests show that the presence of the resonators arranged in the way indicated enables operation the gas turbine down to very small values of AFR; i.e., the range of stability of the combustor is enlarged significantly.

The invention claimed is:

1. A system for damping thermo-acoustic instability in a combustor for a gas turbine, the combustor comprising at least one combustion chamber and at least one burner associated with said combustion chamber and mounted in a position corresponding to a front portion set upstream of said combustion chamber; the damping system comprising a plurality of Helmholtz resonators, said plurality of Helmholtz resonators comprising a casing defining a pre-set volume therein and a neck for hydraulic connection between said pre-set volume and said combustion chamber; said neck connected to one side of said combustion chamber distant from said front upstream portion of said combustion chamber provided with said at least one burner, said casing of said plurality of Helmholtz resonators comprises first and second cup-shaped tubular bodies, which are mounted in a telescopic way co-axially on one another, with respective concavities facing one another, by a threaded coupling; and a threaded fixing ring-nut, which is provided outside said combustion chamber on one of said first and second cup-shaped tubular bodies, in a single piece, with said neck and is configured to bear axially upon the other of said first and second cup-shaped tubular bodies.

2. The system for damping thermo-acoustic instability according to claim 1, said combustion chamber comprises an annular combustion chamber, said plurality of Helmholtz resonators being set in a circumferential position about said combustion chamber, said plurality of Helmholtz resonators housed within an air case for delivery of air for supporting combustion set outside an annular body delimiting said combustion chamber.

3. The system for damping thermo-acoustic instability according to claim 2, said casing of said plurality of Helmholtz resonators comprises a passage configured to deliver cooling fluid.

4. The system for damping thermo-acoustic instability according to claim 3, said passage comprising a plurality of holes having a pre-set diameter extending through said casing of the plurality of Helmholtz resonators and designed to enable passage of part of said air for supporting combustion towards said combustion chamber directly through said pre-set volume and said neck of said plurality of Helmholtz resonators.

5. The system for damping thermo-acoustic instability according to claim 4, wherein said holes are provided only through an end plate of said casing of said plurality of Helmholtz resonators, facing the side opposite to said combustion chamber, and are arranged in positions asymmetrical to one another.

6. The system for damping thermo-acoustic instability according to claim 2, said casing of said plurality of Helmholtz resonators comprises a volume adjuster configured to selectively vary said pre-set volume within a pre-set range.

7. The system for damping thermo-acoustic instability according to claim 2, said casing and said neck of said plurality of Helmholtz resonators have a cylindrical symmetry and are arranged with respective axes of symmetry thereof aligned with one another and oriented to form a pre-set angle with a direction of flow of burnt gases that traverse said combustion chamber.

8. The system for damping thermo-acoustic instability according to claim 7, said pre-set angle being approximately 90°.

9. The system for damping thermo-acoustic instability according to claim 7, said combustor comprising more than one of said burners; said plurality of Helmholtz resonators being mounted circumferentially in a ring, in cantilever orientation on said annular body delimiting said combustion chamber, and with the respective necks hydraulically connected to a downstream portion of said combustion chamber.

* * * * *